313-414 SR

4/20/76 OR 3,952,224

United States Patent [19]

Evans, Jr., deceased

[11] 3,952,224

[45] Apr. 20, 1976

[54] IN-LINE ELECTRON GUNS HAVING CONSECUTIVE GRIDS WITH ALIGNED VERTICAL, SUBSTANTIALLY ELLIPTICAL APERTURES

[75] Inventor: John Evans, Jr., deceased, late of Lancaster, Pa., by Frances M. Evans, executrix

[73] Assignee: RCA Corporation, New York, N.Y.

[22] Filed: Oct. 4, 1974

[21] Appl. No.: 512,227

[52] U.S. Cl. ..... 313/414; 313/453; 313/449

[51] Int. Cl.[2] ..... H01J 29/51; H01J 29/50; H01J 29/56

[58] Field of Search ..... 313/409, 453, 413, 412, 313/414, 415; 319/411–415, 409

[56] References Cited

UNITED STATES PATENTS

| | | | |
|---|---|---|---|
| 3,579,010 | 5/1971 | Jones | 313/453 X |
| 3,603,839 | 9/1971 | Takayanagi | 313/414 X |
| 3,772,554 | 11/1973 | Hughes | 313/414 X |

Other Publications

| | | | |
|---|---|---|---|
| B381,074 | 1/1975 | Hasker et al. | 313/414 X |

*Primary Examiner*—Robert Segal
*Attorney, Agent, or Firm*—Glenn H. Bruestle; Dennis H. Irlbeck

[57] ABSTRACT

In the tube gun, the apertures of the two grids closest to the cathodes are vertically elongated or, preferably, vertically elliptically shaped to provide at least partial compensation for beam distortion occuring in a deflection zone of the tube.

3 Claims, 7 Drawing Figures

IN-LINE ELECTRON GUNS HAVING CONSECUTIVE GRIDS WITH ALIGNED VERTICAL, SUBSTANTIALLY ELLIPTICAL APERTURES

BACKGROUND OF THE INVENTION

The present invention relates to an improvement in an in-line electron gun for a cathode ray tube, particularly a shadow mask type color picture tube. The improved gun is primarily intended for use in a color tube having a line type color phosphor screen, with or without light absorbing guard bands between the color phosphor lines, and a mask having elongated apertures or slits. However, the gun could be used in the well known dot-type color tube having a screen of substantially circular color phosphor dots and mask with substantially circular apertures.

An in-line electron gun is one designed to generate or initiate at least two, and preferably three, electron beams in a common plane, for example, by at least two cathodes, and direct those beams along convergent paths in that plane to a point or small area of convergence near the tube screen.

There has been a general trend toward color picture tubes with greater deflection angles in order to provide shorter tubes. In the transition to a wider deflection tube, e.g., 90° deflection to 110° deflection, it has been found that the electron beam becomes increasingly more distorted as it is scanned toward the outer portions of the screen. Such distortions may be due, at least in part, to variations in the deflection field formed by a yoke mounted on the tube. It is the purpose of the present invention to at least partially compensate for these distortions.

Although the present invention may be applied to several different types of tubes, it is hereinafter described as an improvement on a tube having an inline gun, such as disclosed in U.S. Pat. No. 3,772,554 issued to Hughes on Nov. 13, 1973. For the purpose of gun construction and operation, U.S. Pat. No. 3,772,554 is hereby incorporated by reference. Additionally, for the purpose of yoke construction and operation U.S. Pat. No. 3,721,930 issued to Barkow et al. on Mar. 20, 1973 also hereby incorporated by reference as describing a representative yoke.

SUMMARY OF THE INVENTION

A cathode ray tube comprises an evacuated envelope including a faceplate, a mosaic color phosphor screen on an inner surface of the faceplate, a multiapertured color selection electrode mounted in spaced relationship to the screen, and electron gun means for generating and directing a plurality of electron beams through the electrode to the screen. The gun means includes a plurality of cathodes spaced substantially equal distances from the screen and a plurality of apertured grids spaced from the cathodes toward the screen and spaced from each other. The apertures in the grids are aligned with electron beam paths from the cathodes to said screen. The aligned apertures in two consecutive grids closest to a cathode further are elongated in a common direction.

DETAILED DESCRIPTION OF THE PREFERRED EMBODIMENT

Figure 1:
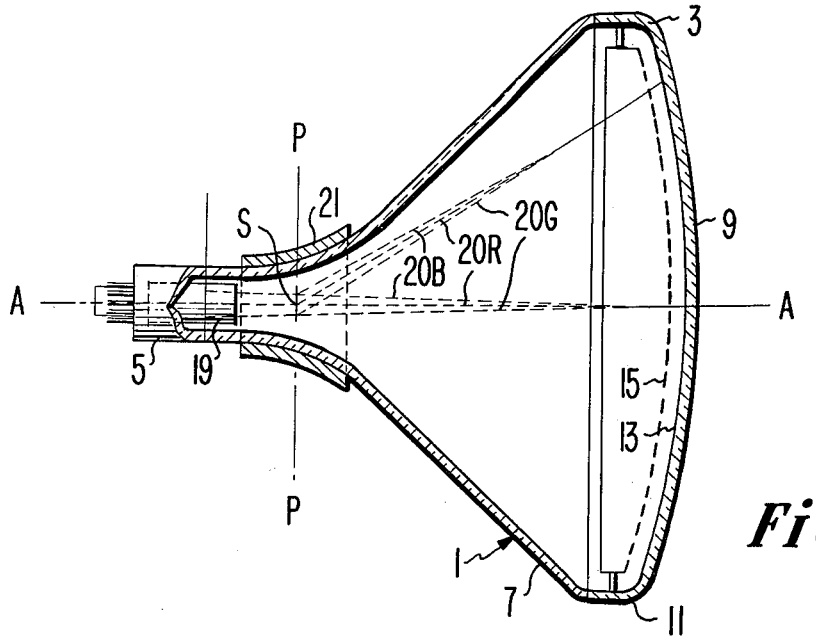
FIG. 1 is a plan view, partly in axial section, of a shadow mask color picture tube in which the present invention is incorporated.
Figure 2:
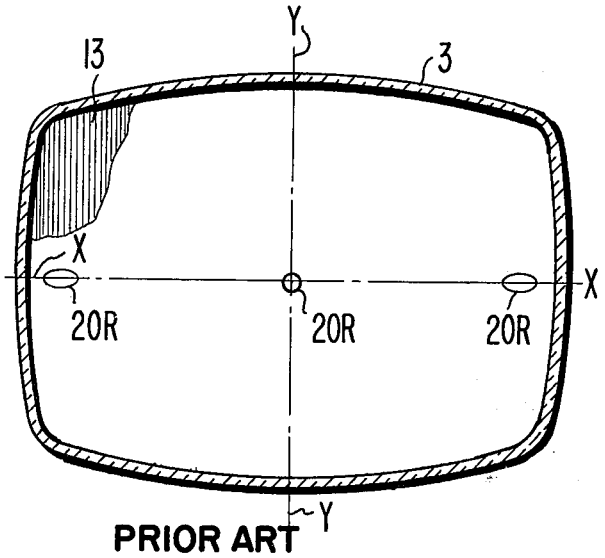
PRIOR ART FIG. 2
FIGS. 2 and 3 are schematic views showing beam spot shapes without and with the invention respectively.
Figure 3:
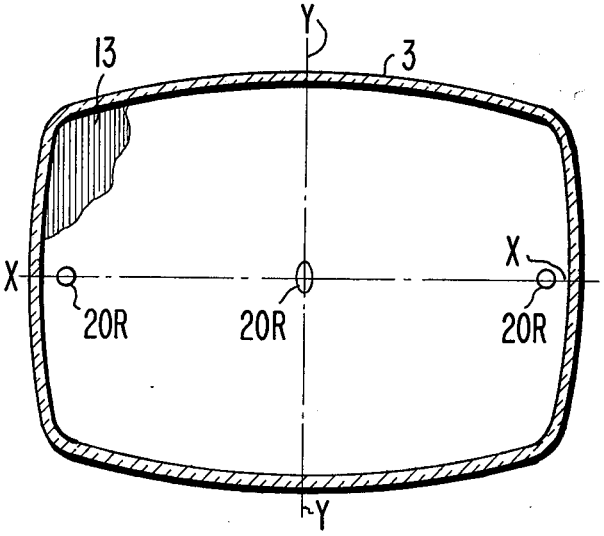

FIG. 1 is a plan view of a rectangular color picture tube, having a glass envelope 1 comprising a rectangular panel or cap 3 and a tubular neck 5 connected by a rectangular funnel 7. The panel 3 comprises a viewing faceplate 9 and a peripheral flange or sidewall which is sealed to the funnel 7. A mosiac three-color phosphor screen 13 is located on the inner surface of the faceplate 9. As shown in FIGS. 2 and 3, the screen 13 is preferably a line screen i.e., comprised of an array of parallel phosphor lines or strips, with the phosphor lines extending substantially parallel to the vertical minor axis Y—Y of the tube. A multiapertured color section electrode or shadow mask 15 is removably mounted, by conventional means, in predetermined spaced relationship to the screen 13. An improved in-line electron gun 19, shown schematically by dotted lines in FIG. 1, is mounted within the neck 5 to generate and direct three electron beams 20B, 20R and 20G along co-planar convergent paths through the mask 15 to the screen 13.

The tube of FIG. 1 is designed to be used with an external magnetic deflection yoke 21, surrounding the neck 5 and funnel 7, in the vicinity of their junction. When appropriate voltages are applied to the yoke 21, the three beams 20B, 20R and 20G are subjected to vertical and horizontal magnetic fields that cause the beams to scan horizontally and vertically in a rectangular raster over the screen 13.

The initial plane of deflection (at zero deflection) is shown by the line P—P in FIG. 1 at about the middle of the yoke 21. Because of fringe fields, the zone of deflection of the tube extends axially, from the yoke 21, into the region of the gun 19. For simplicity, the actual curvature of the deflected beam paths 20 in the deflection zone is not shown in FIG. 1.

FIGS. 2 and 3 are views of the tube screen 13 showing electron beam spot shapes as a beam 20R strikes the screen without and with the present invention, respectively. As shown in FIG. 2, without the present invention the shape of the electron beam at the center of the screen is substantially round but has a horizontally elliptical or elongated shape at the sides of the screen. Horizontal ellipticity is defined as an ellipse having its major axis horizontal.

This elongation of the beam is undesirable because of its adverse effect on video resolution. The elongation occurs because the beam is under-focused in the horizontal dimension. By using the present invention, however, the shape of the beam at the sides of the screen is made substantailly rounder or at least less elongated in the horizontal direction. The compensation that makes the beam rounder at the edges, however, may make the beam at the center of the screen vertically elongated, i.e. elliptical with the major axis of ellipse vertical. This vertical ellipticity causes no resolution problem since vertical resolution is limited by the number of scan lines.

The horizontal ellipticity problem is one encountered with some yokes, such as the self-converging yoke disclosed in U.S. Pat. No. 3,721,930, when designed for wide angle (e.g. 90°, 110°) deflection. Because of tube geometry, deflection yokes used with horizontally in-line circular beams and designed to produce self-convergence along the horizontal axis of the tube must have a deflection field which diverges the beams as horizontal deflection angle increases. This horizontal divergence is achieved with a yoke capable of forming an astigmatic field, that, while diverging the beams in the horizontal plane with horizontal deflection, also causes vertical convergence of the electrons within each individual beam. Taken alone, this vertical convergence of electrons in each beam has no effect on horizontal beam spacing, the astigmatic field also diverges or defocuses each individual beam horizontally as it converges or focuses it vertically. A typical resultant electron beam spot produced at the center of the screen on a 25V–110° in-line tube when subjected to an astigmatic field is a round spot 4.6 mm. in diameter. However, corner spots are elongated in the horizontal direction having a horizontal length of 7.9 mm. and a vertical height of 2.7 mm. The corner spot ellipticity is thus 2.9/1.0.

The horizontal dimension of the electron beam spot can be reduced by decreasing the focus voltage, however, such voltage adjustment has an adverse effect on the beam in the vertical direction causing it to be over focussed vertically, thereby degrading vertical video resolution. Adjustment of the focus voltage alone will not provide an acceptable electron spot. Therefore, a change in focus voltage must be accompanied by some other means or method that will alter the shape of the electron beam. A preferable means for providing such alteration includes providing sufficient astigmatism in the electron gun so that a focus voltage can be obtained that provides optimum focusing of the electron beam in both the vertical and horizontal directions. Such optimum focus voltage may be compromised between the ideal voltages required for perfect focusing in each of the two orthogonal directions. With focus voltage set to provide optimum focus at the edge of the screen, the undeflected spot at the center of the screen becomes vertically elongated. In effect then, the present invention provides sufficient astigmatism in the electron gun to reduce the beam spot distortion problem at the edges of the screen caused by the yoke by providing a compensating opposite distortion in the gun in the form of a preshaping of the beam before it enters the yoke field. This preshaping involves somewhat comprising the spot shape at the center of the screen.

Figure 6:
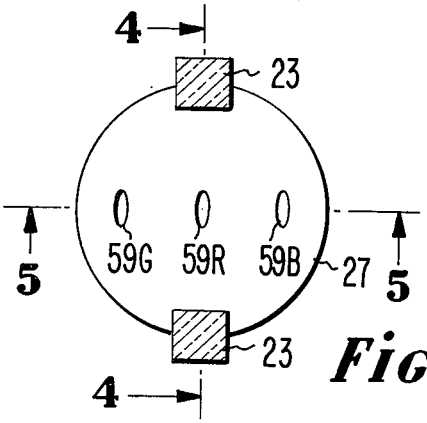
FIG. 6 is a section view of the electron gun taken along the line 6—6 of FIGS. 4 and 5.
Figure 4:
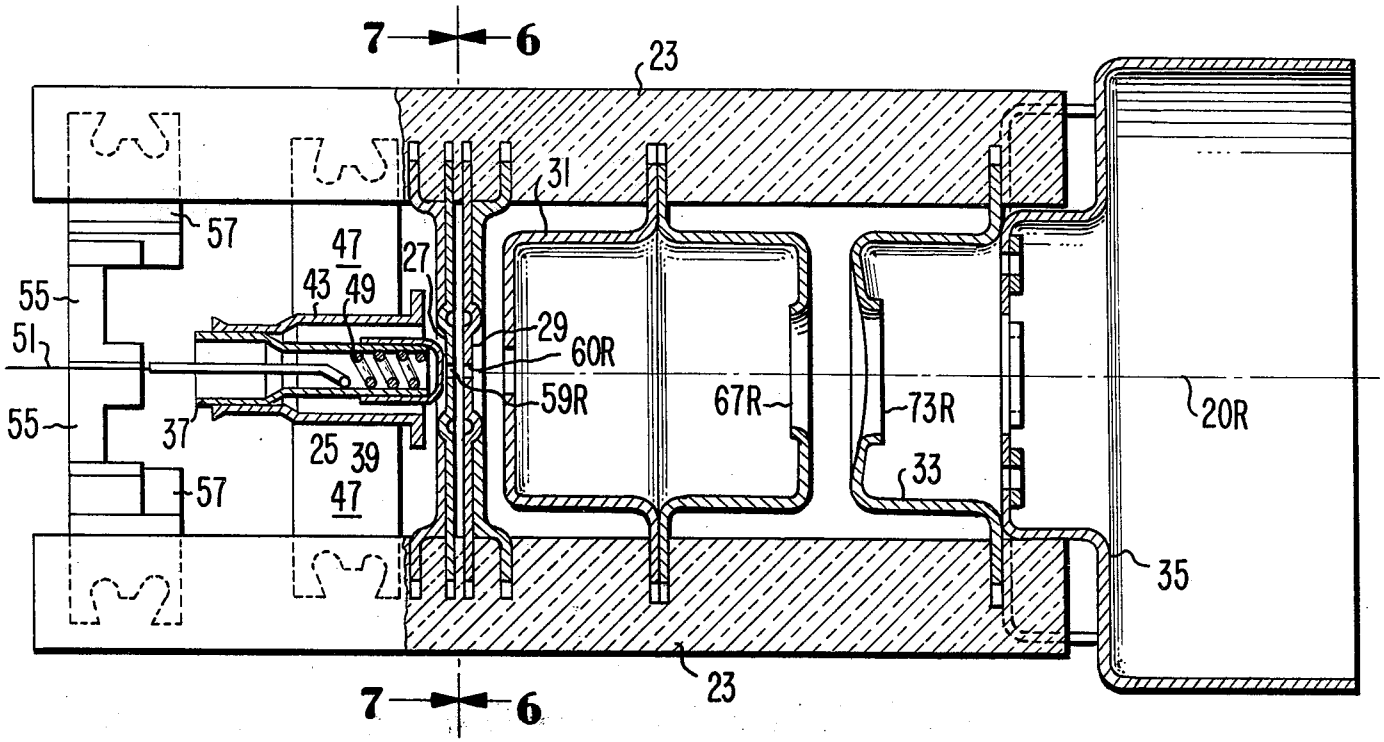
FIGS. 4 and 5 are enlarged axial section views of the electron gun shown in dotted lines in FIG. 1 taken along certain places which are perpendicular to each other as shown respectively by the lines 4—4 and 5—5 in FIG. 6.
Figure 5:
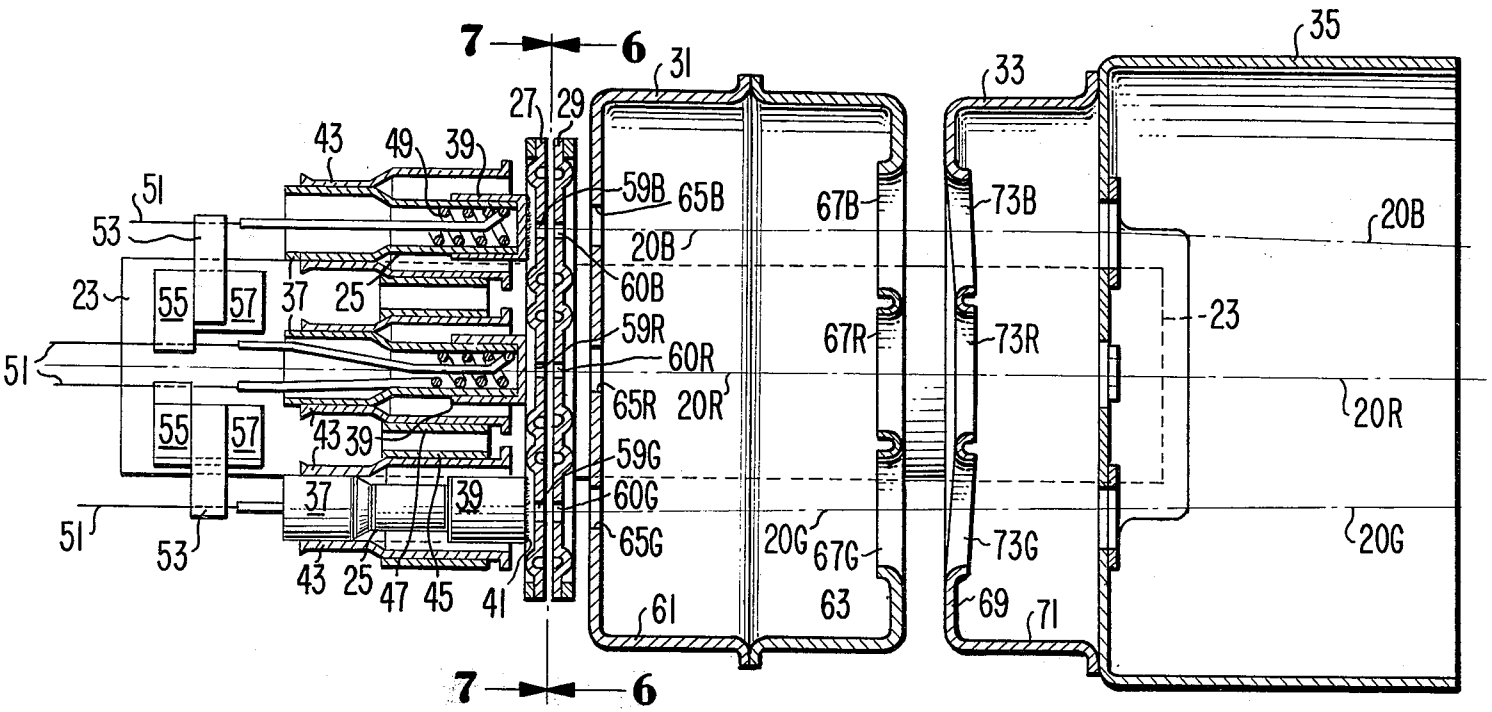

The details of the improved gun 19 are shown in FIGS. 4, 5 and 6. For illustration, the inventive improvement is shown as being added to the gun disclosed in U.S. Pat. No. 3,773,554. The gun 19 comprises two glass support rods 23 on which the various grid electrodes are mounted. These electrodes include three equally-spaced co-planar cathodes 25 (one for each beam), a control grid electrode 27, a screen grid electrode 29, a first accelerating and focusing electrode 31, a second accelerating and focusing electrode 33, and a shield cup 35. All of these components are spaced along the glass rods 23 in the order named.

Each cathode 25 comprises a cathode sleeve 37, closed at the forward end by a cap 39 having an end coating 41 of electron emissive material. Each sleeve is supported in a cathode support tube 43. The tubes 43 are supported on the rods 23 by four straps 45 and 47. Each cathode 25 is indirectly heated by a heater coil 49 positioned within the sleeve 37 and having legs 51 welded to heater straps 53 and 55 mounted by studs 57 on the rods 23.

The control and screen grid electrodes 27 and 29 are two closely-spaced (about 0.23 mm. apart) flat plates, each having three apertures 59G, 59R and 59B and 60G, 60R and 60B, respectively, centered with the cathode coatings 41 and aligned with the apertures of the other along a central beam path 20R and two outer beam paths 20G and 20B extending toward the screen 13. The outer beam paths 20G and 20B are equally spaced from the central beam path 20R. Preferably, the initial portions of the beam paths 20G, 20R and 20B are substantially parallel and about 5 mm. apart, with the middle path 20R coincident with the central axis A—A.

The first accelerating and focusing electrode 31 comprises first and second cup-shaped members 61 and 63, respectively, joined together at their open ends. The first cup-shaped member 61 has three medium sized (about 1.5 mm.) apertures 65G, 65R and 65B close to the grid electrode 29 and aligned respectively with the three beam paths 20G, 20R and 20B, as shown in FIG. 5. The second cup-shaped member 63 has three large (about 4 mm.) apertures 67G, 67R and 67B also aligned with the three beam paths.

The second accelerating and focusing electrode 33 is also cup-shaped and comprises a base plate portion 69 positioned close (about 1.5 mm) to the first accelerating electrode 31 and a side wall of flange 71 extending forward toward the tube screen. The base portion 69 is formed with three apertures 73G, 73R and 73B which are preferably slightly larger (about 4.4 mm.) than the adjacent apertures 67G, 67R and 67B of electrode 31. The middle aperture 73R is aligned with the adjacent middle aperture 67R (and middle beam path 20R, to provide a substantially symmetrical beam focusing electric field between apertures 67R and 73R when electrodes 31 and 33 are energized at different voltages. The two outer apertures 73G and 73B are slightly offset outwardly with respect to the corresponding outer apertures 67G and 67B, to provide an asymmetrical electric field between each pair of outer apertures when electrodes 31 and 33 are energized, to individually focus each outer beam 20G and 20B near the screen, and also to deflect each outer beam toward the middle beam 20R to a common point of convergence with the middle beam near the screen. In the example shown, the offset of the beam apertures 73G and 73B may be about 0.15 mm.

Figure 7:
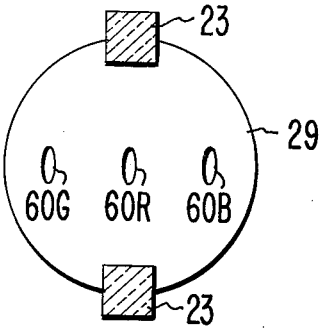
FIG. 7 is a sectional view of the electron gun taken along the line 7—7 of FIGS. 4 and 5.

In order to provide correction for the aforementioned beam flattening as horizontal deflection angle is increased, each beam is predistorted in the gun so that it is vertically defocused at the center of the screen resulting in vertical elongation of the undeflected beam spot. This predistortion, or preshaping, of the beams is accomplished by using vertically elongated, or preferably, vertically elliptical apertures in both of the grids nearest the cathodes, viz., the control grid electrode 27 and the screen grid electrode 29. Elliptical shaping of the apertures 59G, 59R and 59B in the control grid 27 is shown in FIG. 6 and of the apertures 60G, 60R and 60B in the screen grid 29 is shown in FIG. 7. Of course, the degree of ellipticity required depends on the specific type of tube used. However, for the center beam of a 25 V–110° in-line tube as previously described having an edge electron beam spot ellipticity of 2.9/1.0 in the absence of the present invention, a vertically elliptical aperture having an ellipticity of 1.6/1.0 provides sufficient preshaping of the beam to obtain a substantially round beam at the edge of the screen. Typical aperture dimensions that meet this ellipticity requirement are approximately 0.5 mm. horizontal and approximately 0.8 mm. vertical.

It has been noticed that a gun such as disclosed in U.S. Pat. No. 3,773,554 does produce outer beams having some degree of vertical ellipticity due to the close spacing of the electron lenses. Therefore, the required ellipticity of the outer beam apertures in the control and screen grid electrodes can be made somewhat less than the ellipticity of the center beam apertures. To accomplish this, the ellipticity of the outer beam apertures are made 1.4/1.0 while the center beam apertures are held at an ellipticity of 1.6/1.0. Typical dimensions of the outer beam apertures that meet this requirement are about 0.55 mm. horizontal and about 0.76 mm. vertical.

Although the present invention has been described with respect to an inline electron gun, it is to be understood that the basic inventive concept of the present invention may also be applied to delta type electron guns to solve similar beam flattening.

It is claimed that:

1. In a cathode-ray tube comprising, an evacuated envelope including a faceplate, a mosaic color phosphor screen on an inner surface of said faceplate, a multiapertured color selection electrode in spaced relationship to said screen, an in-line electron gun means for generating and directing a plurality of electron beams along co-planar paths through said color selection electrode to said screen, said gun means including a plurality of in-line cathodes and a plurality of grids spaced between said cathodes and said selection electrode each grid having a plurality of apertures aligned respectively with the electron beam paths, wherein said beams are subjected to vertical and horizontal magnetic deflection fields during operation of said tube for scanning said beams horizontally and vertically over said screen within a deflection zone located between said gun means and said color selection electrode and said electron beams tend to be distorted into horizontally elliptical shapes when they strike the screen as deflection angle increases by the magnetic deflection fields, the improvement comprising, two consecutive grids nearest the cathodes having vertically substantially elliptical apertures therein, including aligned apertures in the two consecutive grids nearest the cathodes having a different elliptical shape than the other apertures in said two consecutive grids, whereby the tendancy of said beams to be distorted into horizontally elliptical shapes when they strike the screen is at least partially compensated by introducing astigmatism into the beams within said gun means, and the introduced astigmatism is different for at least two different beams.

2. The tube as defined in claim 1, including each of said two consecutive grids nearest the cathodes having a center beam aperture and two outer beam apertures, wherein the ratio of major axis dimension to minor axis dimension of center beam apertures in said two consecutive grids nearest the cathodes is greater than the same ratio for an outer beam aperture.

3. The tube as defined in claim 2, wherein said ratio for the center beam aperture is about 1.6 and the ratio for an outer beam aperture is about 1.4.

* * * * *